United States Patent [19]

Binoche

[11] 4,219,157

[45] Aug. 26, 1980

[54] HYDROSTATIC PAINT ATOMIZATION SPRAY-GUN

[75] Inventor: Michel Binoche, Paris, France

[73] Assignee: S.K.M., Stains, France

[21] Appl. No.: 884,487

[22] Filed: Mar. 8, 1978

[30] Foreign Application Priority Data

Mar. 10, 1977 [FR] France ..... 77 07064
Jul. 22, 1977 [FR] France ..... 77 22592

[51] Int. Cl.[2] ..... B05B 1/04; B05B 7/08
[52] U.S. Cl. ..... 239/296; 239/299
[58] Field of Search ..... 239/290, 296, 297, 299, 239/300, 599

[56] References Cited

U.S. PATENT DOCUMENTS

| | | | |
|---|---|---|---|
| 2,475,000 | 7/1949 | Beach, Jr. | 239/300 |
| 2,518,759 | 8/1950 | Dalrymple | 239/300 |
| 2,530,206 | 11/1950 | Nieburg | 239/300 |
| 2,569,251 | 9/1951 | Nieburg | 239/297 X |

FOREIGN PATENT DOCUMENTS

| | | | |
|---|---|---|---|
| 2269378 | 11/1975 | France | 239/296 |
| 2303603 | 10/1976 | France | 239/296 |

*Primary Examiner*—Robert W. Saifer

[57] ABSTRACT

This hydrostatic atomization paint spray-gun produces A flat jet of paint surrounded by several flat jets of compressed air and comprises at least two complementary jets of compressed air coplanar with the paint jet and converging towards the latter. Thus, the width of the paint jet can be adjusted to reduce it for example to one-half of its width without said complementary jets.

2 Claims, 7 Drawing Figures

HYDROSTATIC PAINT ATOMIZATION SPRAY-GUN

FIELD OF THE INVENTION

When paint spray-guns are used, it is preferable in most instances to produce more or less divergent flat paint jet, which is more convenient than a circular or elliptic jet.

Pneumatic-atomization paint spray-guns produce a circular-sectioned jet which is flattened by means of air jets disposed symmetrically in relation to the plane of the jet to be formed, said air jets converging towards the cylindrical paint jet; by properly adjusting the pressure producing said air jets, it is possible to vary at will the width of the flat paint jet.

With hydrostatic atomization paint spray-guns a flat sheet of paint is obtained automatically since the nozzle or nose through which the high-pressure paint jet escapes comprises a spherical- or elliptical-bottomed blind hole opened by a dihedron-shaped slot of which the edge extends at right angles to the axis of said blind hole and is more or less coincident with the centre of the spherical bottom, the hole axis lying in the bisecting plane of the dihedron.

The width of the flat sheet of paint thus obtained varies only very slightly with the atomizing pressure; besides, this pressure can hardly be reduced without impairing the atomization quality.

BACKGROUND OF THE INVENTION

However, as explained in various prior patents, the Applicant found that it was possible to operate under a relatively low atomizing pressure, for example as low as 20 to 40 bars, by utilizing one or a plurality of low-pressure compressed air, for instance air jets under a pressure of 1 to 2 bars, in order to create a compressed air sheet parallel to, and surrounding completely the flat jet of paint, both on its upper face and on its lower face, and also laterally.

SUMMARY OF THE INVENTION

Now according to the present invention it was found that a hydrostatic atomization paint spray-gun of the type broadly disclosed hereinabove could easily be so arranged as to make it possible to adjust the width of its paint jet through a relatively large extent, for example from its normal width to half this width.

For this purpose, the hydrostatic atomization paint spray-gun according to the present invention, of the type wherein the flat jet of paint is surrounded by a plurality of flat jets of compressed air, is characterized in that it further comprises at least two complementary jets of compressed air, coplanar with, and adapted to converge towards, the paint jet, by using means affording an accurate adjustment of the amount of compressed air feeding said complementary jets.

Each one of these at least two complementary air jets may be replaced by two air jets disposed symmetrically on either side of the plane of the paint jet and converging towards this jet; if desired, said complementary air jets may converge towards the axis of the paint jet, but practical tests proved that better results could be obtained by causing said air jets to converge before reaching said axis.

According to a preferred form of embodiment having led to particularly satisfactory results, these two symmetrical jets are disposed on either side of the plane of the paint jet, each one in a plane parallel to the paint jet axis and forming with the plane of said paint jet an angle of about 45 degrees while being inclined forwardly by an angle of about 30 degrees in relation to a plane parallel to the axis of the paint jet.

BRIEF DESCRIPTION OF THE DRAWINGS

The accompanying drawing illustrates by way of example two typical forms of embodiment of the present invention.

DESCRIPTION OF THE PREFERRED EMBODIMENT

Figure 1:
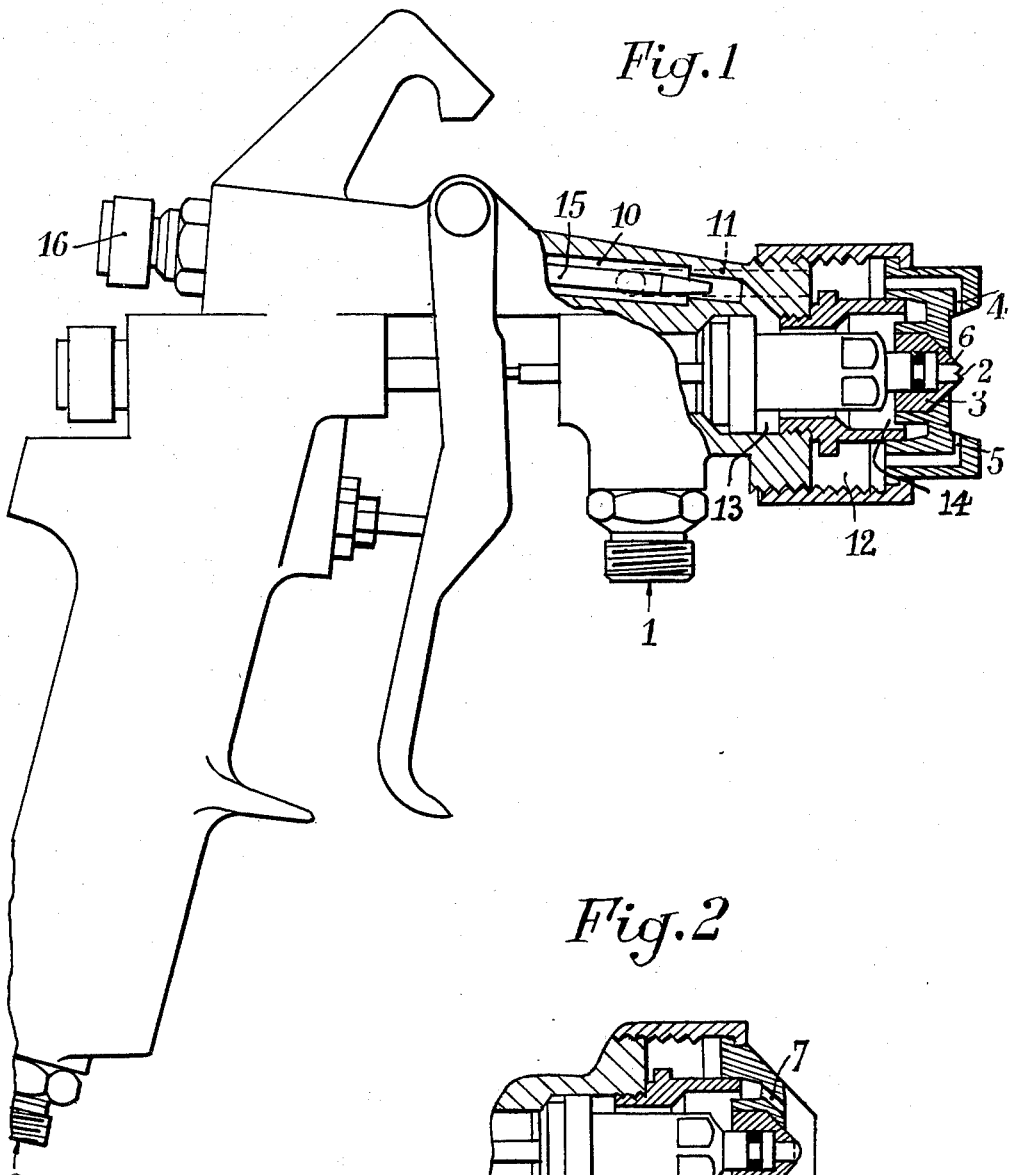
FIG. 1 is a part-elevational, part-sectional view of a first form of embodiment, the fragmentary section being taken along the longitudinal axis of the spray-gun.
Figure 2:
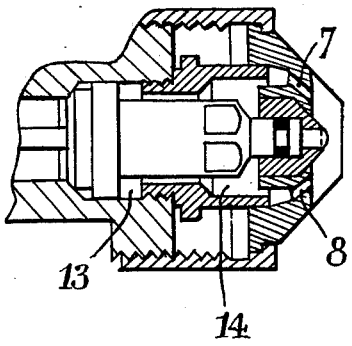
FIG. 2 is a longitudinal section taken at right angle to that of FIG. 1.

In the spray gun illustrated in FIGS. 1 and 2 of the drawing, the paint is supplied through a union 1 and forced under pressure to form a flat jet through the slot 2 formed at the front portion of the atomization nozzle or nose 3.

In a manner known per se, and in order to reduce appreciably the atomization pressure without impairing inasmuch the atomization quality, two jets of compressed air are directed through symmetric opposed outlet orifices 4, 5 disposed at right angles to the plane of the sheet of paint issuing from the nozzle 3, and directed towards the front tapered surface 6 of this nozzle, said air jet rebounding on said tapered surface 6 to form two air sheets surrounding the paint sheet.

In a plane extending at right angles to that comprising said outlets orifices 4, 5 and therefore in the plane of the paint sheet issuing from the nozzle 3, another pair of inclined outlet orifices 7, 8 directed towards the paint jet and adapted to impinge on the lateral edges of this paint jet, are provided slightly ahead of the point of emission of this paint jet; all these compressed air jets are derived from a common main supply hose (not shown) connected to a union 9 and flow via passage 10, and either through a conduit 11 and annular chamber 12 to said outlet orifices 4, 5 or through an annular passages 13, 14 leading to said inclined outlet orifices 7 and 8.

Figure 3:
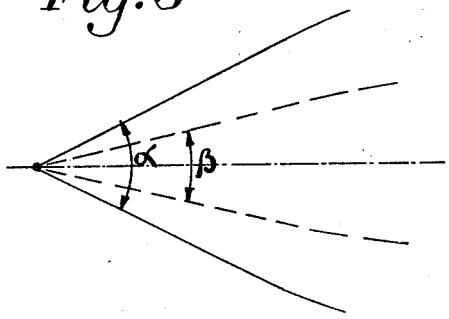
FIG. 3 is a plan view of the paint jet obtained with the spray-gun shown in FIGS. 1 and 2.
Figure 4:
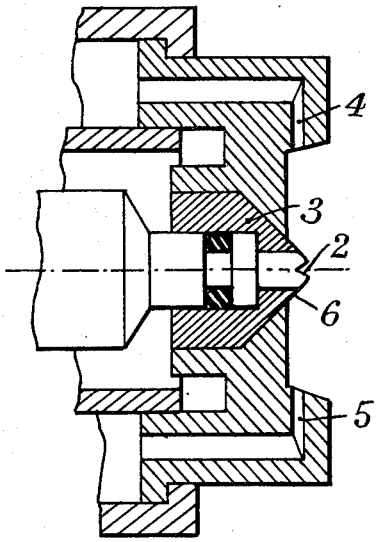
FIG. 4 is a longitudinal section taken along the plane of symmetry of the spray-gun, showing the front portion of a modified form of embodiment thereof.
Figure 5:
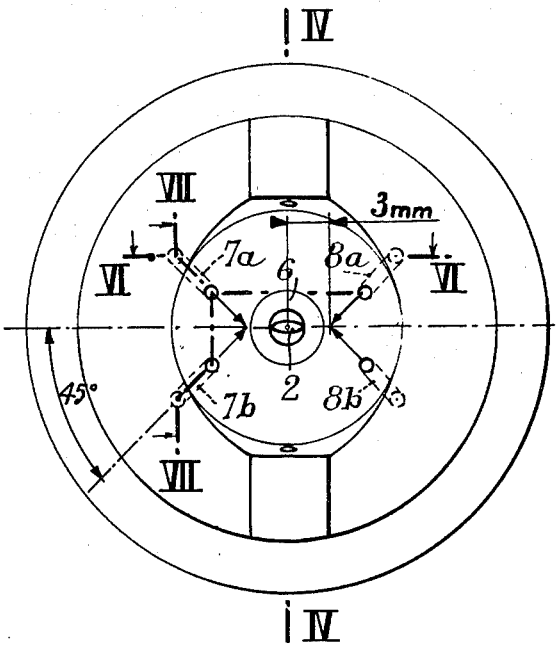
FIG. 5 is a front view of the assembly shown in FIG. 4.
Figure 6:
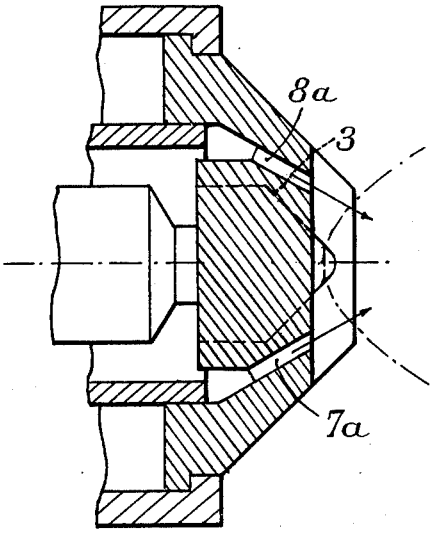
FIGS. 6 and 7 are longitudinal sections taken along the broken lines VI—VI and VII—VII of FIG. 5, respectively.
Figure 7:
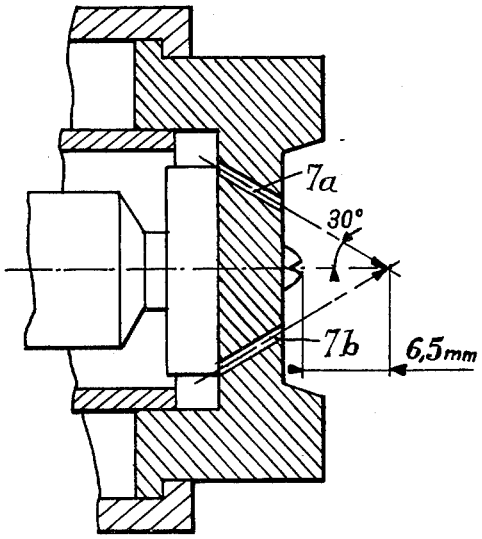

A needle valve 15 controllable by means of an external knob 16 is provided for adjusting at will the pressure of the compressed air supplied to the inclined outlet orifices 7, 8. When this needle valve 15 closes completely the passage provided for delivering compressed air to outlet orifices 7 and 8, the paint sheet has its maximum width (denoted $\alpha$ in FIG. 3), and if on the other hand the needle valve 15 is retracted to its open or inoperative position, and if the pressure of the compressed air delivered to outlet orifices 7, 8 has its maximum value, the aperture angle of the flat jet of paint is reduced considerably and may be reduced to a value $\beta$, for example, which is about one-half of angle $\alpha$.

In the modified form of embodiment illustrated in FIGS. 4 to 7 of the drawing the paint is again projected under pressure in the form of a flat jet through the slot 2 formed at the front end of atomization nozzle or nose 3, and to reduce considerably the atomization pressure without inasmuch impairing the atomization quality, two jets of compressed air are directed through the symmetrical outlet orifices 4 and 5 disposed at right angles to the plane of the sheet of paint issuing from the nozzle 3 and caused to impinge on the tapered front surface of this nozzle, said air jets rebounding on said tapered surface to form two air sheets surrounding the paint sheet.

Two complementary pairs of outlet orifices, disposed symmetrically in relation to the paint sheet plane, respectively *7a, 7b* on one side and *8a, 8b* on the other side, produce compressed air jets converging by pairs in the plane of the paint sheet, on this side of the paint jet, at a distance from the axis thereof and at an angle which are subordinate to the shape of the paint jet.

In the present case, the four outlet orifices *7a, 7b* and *8a, 8b* lie in planes parallel to the axis of the paint jet and are set at an angle of 45 degrees to the plane containing the paint sheet; moreover, in this plane, they are inclined forwards by 30 degrees to the horizontal, and open on either side of the plane containing the paint sheet so that the jets of compressed air passing through these outlet orifices meet one another in this plane at a distance of about 3 mm from the axis of the paint jet and about 6.5 mm beyond the front end of the nozzle or nose 3.

Of course, the two forms of embodiment of the present invention which are described hereinabove with reference to the accompanying drawing should not be construed as limiting the scope of the present invention since they are given by way of example, not of limitation, and many modifications and changes may be brought thereto without departing from the basic principles of the invention as set forth in the appended claims. Thus, notably, the position, orientation and diameter of the outlet orifices may be modified to a large extent, and are selected in general to permit of reducing by one-half the width of the paint jet obtained when they are not in use; if this jet is narrow, its width may be reduced until it assumes a circular cross-section as a consequence of the action exerted by the jets of compressed air issuing from said outlet orifices.

What is claimed as new is:

1. A hydrostatic-atomization paint spray-gun of the type having an elongated nozzle outlet for hydrostatically discharging a flat jet of paint and means for producing two jets of compressed air which jets are deflected to completely surround the jet of paint, there being further provided means for producing at least two further jets of compressed air lying in the same plane as the jet of paint and converging towards said paint jet said means for producing the further jets of compressed air comprising two pairs of outlets, each pair being disposed symmetrically on either side of the plane of the paint jet so as to produce a pair of air jets converging to form a respective one of the further air jets wherein the outlets disposed on either side of the plane of the paint jet are each arranged to produce an air jet in a plane parallel to the axis of said paint jet so as to form with the plane of said paint jet an angle of substantially 45 degrees, and are inclined forwardly by an angle of substantially 30 degrees, to a plane parallel to the axis of said paint jet, and means for adjusting the amount of compressed air supplied to form said further jets.

2. A paint spray-gun as claimed in claim 1, in which the outlets through which the further compressed-air jets are sprayed open on either side of the plane containing the paint sheet so that the compressed air jets issuing from said outlets meet each other in said plane at a distance of substantially 3 mm from the axis of the paint jet and 6.5 mm beyond the front end of the nozzle.

* * * * *